US011657992B2

(12) United States Patent
Stallmer

(10) Patent No.: US 11,657,992 B2
(45) Date of Patent: May 23, 2023

(54) PROTECTIVE COVER ASSEMBLY FOR MAGNETICALLY ACTUATING AN ELECTRICAL WALL SWITCH

(71) Applicant: Jeffrey A. Stallmer, Cohoes, NY (US)

(72) Inventor: Jeffrey A. Stallmer, Cohoes, NY (US)

( * ) Notice: Subject to any disclaimer, the term of this patent is extended or adjusted under 35 U.S.C. 154(b) by 239 days.

(21) Appl. No.: 16/867,723

(22) Filed: May 6, 2020

(65) Prior Publication Data

US 2020/0357588 A1 Nov. 12, 2020

Related U.S. Application Data

(60) Provisional application No. 62/843,735, filed on May 6, 2019.

(51) Int. Cl.
*H01H 36/00* (2006.01)
*H01H 35/02* (2006.01)
(Continued)

(52) U.S. Cl.
CPC ..... *H01H 36/002* (2013.01); *H01H 23/04* (2013.01); *H01H 23/148* (2013.01); *H01H 35/02* (2013.01); *H01H 36/0033* (2013.01)

(58) Field of Classification Search
CPC ..... H01H 3/00; H01H 3/50; H01H 36/002; H01H 23/04; H01H 23/148; H01H 35/02;
(Continued)

(56) References Cited

U.S. PATENT DOCUMENTS 5,118,196 A * 6/1992 Ault ..... H01J 65/042 315/76
7,214,898 B1 5/2007 Margareten
(Continued)

FOREIGN PATENT DOCUMENTS

CN 2881936 Y * 3/2007
CN 2904267 5/2007
(Continued)

OTHER PUBLICATIONS

Magnetic Cabinet Drawer Locks for Baby Safety Child Proof Kids (Hidden Magnetic Latch Lock Systems), ebay webpage, printout available on Mar. 7, 2019, at https://www.ebay.com/itm/Magnetic-Cabinet-Drawer-Locks-for-Baby-Sa . . . , 4 pages, Mar. 7, 2019.
(Continued)

*Primary Examiner* — Anthony R Jimenez
(74) *Attorney, Agent, or Firm* — Heslin Rothenberg Farley & Mesiti P.C.

(57) ABSTRACT

A protective cover assembly for an electrical wall switch disposed on a wall in which the electrical wall switch has an actuator physically contactable and actuatable by a user for controlling electrical power to a load from an electrical power source. The protective cover assembly may include an enclosure and a connector for connecting the enclosure over the electrical wall switch to inhibit a user from physically contacting and actuating the actuator. A first magnetic material member is attached to or disposed in the actuator. A tool includes a second magnetic material member. When the tool is moved relative to the outer surface of the enclosure, a magnetic force acting through the enclosure is operable to move the actuator from a first position to a second position thereby moving the actuator for controlling electrical power to the electrical load.

16 Claims, 15 Drawing Sheets

(51) Int. Cl.
*H01H 23/14* (2006.01)
*H01H 23/04* (2006.01)

(58) Field of Classification Search
CPC ..... H01H 36/0033; H01H 5/00; H01H 5/02; H01H 2003/0285; H01H 2013/50; H01H 2036/00; H01H 2219/004; H01H 2221/00; H01H 2221/016; H01H 2221/008; H01H 2223/00; H01H 2223/002; H01H 2223/003; H01H 3/32; H01H 3/46; H01H 3/54; H01H 3/56; H01H 3/66; H01H 15/00; H01H 2003/32; H01H 2003/46
USPC ..... 335/202
See application file for complete search history.

(56) References Cited

U.S. PATENT DOCUMENTS

| | | | | |
|---|---|---|---|---|
| 7,924,125 | B2 | 4/2011 | Nishiguchi et al. | |
| 8,016,330 | B2 | 9/2011 | Fullerton et al. | |
| 8,638,185 | B1 * | 1/2014 | Lu | H01H 36/00 335/207 |
| D708,153 | S | 7/2014 | Todd | |
| D731,444 | S | 6/2015 | Todd | |
| 9,177,734 | B2 | 11/2015 | Todd | |
| 9,754,749 | B2 | 9/2017 | Son | |
| 9,997,315 | B2 | 6/2018 | Shimada | |
| 10,141,141 | B2 | 11/2018 | Bergum | |
| 10,192,666 | B2 | 1/2019 | Spratte et al. | |
| 2007/0018766 | A1 | 1/2007 | Poyner | |
| 2008/0258853 | A1 | 10/2008 | Yamada et al. | |
| 2010/0127626 | A1 * | 5/2010 | Altonen | H05B 39/085 315/129 |
| 2011/0018659 | A1 | 1/2011 | Fullerton et al. | |
| 2016/0240331 | A1 | 8/2016 | Honda et al. | |
| 2016/0343497 | A1 * | 11/2016 | Clark | H01C 10/30 |
| 2017/0062168 | A1 | 3/2017 | Amirthasamy et al. | |

FOREIGN PATENT DOCUMENTS

| | | |
|---|---|---|
| CN | 101996783 | 3/2011 |
| CN | 107887192 | 4/2018 |
| CN | 207977272 | 10/2018 |
| JP | 2009087904 | 4/2009 |
| WO | 2016077660 | 5/2016 |

OTHER PUBLICATIONS

Switch Shield Clear Protective Switch Covers—Rocker Style, by Mark One Industries Inc., Jacksonville, Florida, 10 pages, at least as early as Mar. 21, 2019.
Switch Shield Clear Protective Switch Covers—Toggle Style, by Mark One Industries Inc., Jacksonville, Florida, 9 pages, at least as early as Mar. 21, 2019.
One page printout with images of 6 devices attachable to a light switch, at least as early as Feb. 12, 2019.
One page printout with images of 4 devices attachable to a light switch, at least as early as Feb. 12, 2019.

* cited by examiner

PROTECTIVE COVER ASSEMBLY FOR MAGNETICALLY ACTUATING AN ELECTRICAL WALL SWITCH

CLAIM TO PRIORITY

This application perfects and claims priority benefit of U.S. Provisional Patent Application No. 62/843,735, filed May 6, 2019, and entitled "Protective Cover Assembly For Magnetically Actuating An Electrical Wall Switch," which application is hereby incorporated herein by reference in its entirety.

FIELD OF THE DISCLOSURE

The present disclosure relates generally to protective covers for electrical wall switches, and more particularly to protective cover assemblies for magnetically actuating one or more electrical wall switches.

BACKGROUND

Electrical wall switches are generally exposed and subject to operation by any person or child in the area. This can be an inconvenience to those who monitor neurologically challenged individuals, who have a compulsion to continually switch a light switch on and off continuously without regard to others nearby. It presents a constant challenge of the parents or caregivers of a special needs person.

At present, the majority of electrical wall switches such as light switches in residences, schools, hospitals, businesses and other public places are exposed and can be easily operated by any passerby, child or adult.

SUMMARY

Shortcomings of the prior art are overcome and additional advantages are provided through the provision, in one embodiment, of a protective cover assembly for an electrical wall switch disposed on a wall, in which the electrical wall switch includes an actuator physically contactable and actuatable by a user for controlling electrical power to a load from an electrical power source. The protective cover assembly may include, for example, an enclosure having a sidewall having an inner surface and an outer surface, a connector for connecting the enclosure over the electrical wall switch to inhibit the user from physically contacting and actuating the actuator of the electrical wall switch, a slider slidably mounted within the enclosure and engageable with the actuator of the electrical wall switch. The slider is movable between a first position and a second position along the inner surface of the enclosure, and the slider has a first magnetic material member. A tool has a second magnetic material member. The first magnetic material member and the second magnetic material member operable to form a magnetic force therebetween. When the user moves the tool in an axial direction along the outer surface of the enclosure covering the electrical wall switch, the magnetic force acting through the enclosure is operable to move the slider from the first position to the second position thereby moving the actuator from a first position to a second position for controlling electrical power to the electrical load. When the user moves the tool in a second axial direction along the outer surface of the enclosure covering the electrical wall switch, the magnetic force acting through the enclosure is operable to move the slider from the second position to the first position thereby moving the actuator from the second position to the first position for controlling electrical power to the electrical load.

In another embodiment, a protective cover assembly is provided for an electrical wall switch disposed on a wall in which the electrical wall switch includes an actuator physically contactable and actuatable by a user for controlling electrical power to a load from an electrical power source. The protective cover assembly may include, for example, an enclosure having a sidewall having an inner surface and an outer surface, a connector for connecting the enclosure over the electrical wall switch to inhibit a user from physically contacting and actuating the actuator of the electrical wall switch, and at least one first magnetic material member attachable to the actuator. A tool has a second magnetic material member. The first magnetic material member and the second magnetic material member form a magnetic force therebetween. When the user moves said tool in a first direction adjacent to the outer surface of the enclosure covering the at least one first magnetic material member attached to the actuator, the magnetic force acting through the enclosure is operable to move the actuator from a first position to a second position for controlling electrical power to the electrical load. When the user moves said tool a second direction adjacent to said outer surface of said enclosure covering said at least one first magnetic material member attached to the actuator, the magnetic force acting through said enclosure is operable to move the actuator from the second position to the first position for controlling electrical power to the electrical load.

In another embodiment, an electrical wall switch is provided for use in controlling, via a magnetic force, electrical power to a load from an electrical power source. The electrical wall switch may include, for example, a housing, a controller disposed in the housing for controlling the electrical power to the load, an actuator movable between a first position and a second position by a user, the actuator having an outer surface contactable by the user for moving the actuator between the first position and the second position, and a magnetic material member disposed in the actuator below the outer surface. The actuator is movable, via the magnetic force and without physically contacting the actuator, from the first position to the second position for controlling electrical power to the electrical load. The actuator is movable, via the magnetic force and without physically contacting said actuator, from said second position to said first position for controlling electrical power to the electrical load.

In another embodiment, a method for operating an electrical wall switch for controlling electrical power to a load from an electrical power source is provided. The method may include, for example, moving, via a magnetic force acting through an enclosure disposed over an actuator of the electrical wall switch, the actuator from a first position to a second position without physically contacting the actuator to control the electrical power to the electrical load, and moving, via the magnetic force acting through the enclosure disposed over the actuator of the electrical wall switch, the actuator from the second position to the first position without physically contacting the actuator to control the electrical power to the electrical load.

In another embodiment, a method for inhibiting physical contact with an actuator of an electrical wall switch is provided. The electrical wall switch is operable for controlling electrical power to a load from an electrical power source. The method may include, for example, attaching at least one magnetic material member to the actuator of the electrical wall switch, and securing an enclosure over the magnetic material member and actuator of the electrical wall switch.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

The present disclosure is directed to providing a means for safeguarding an electrical switch in those instances where security is necessary. Some electrical switches may require that only authorized persons operate the switch, and other electrical switches such as furnace or fireplace switches should generally not be operated by a person without the intelligence, or need, to operate the switch.

The present disclosure may be operable for providing a safe and reliable way to operate a variety of electrical switches, such as electrical toggle switches and electrical rocker switches, without the user physically accessing, touching or contacting the toggle or rocker actuator himself or using an object to physically contact the toggle or rocker actuator.

Benefits of the present disclosure may include the ability to add a protective cover in situ, in particular cases, to any existing type of electrical switch, single or multiple switches, and to any style electrical switches including, but not limited to, electrical push button switches, electrical toggle switches, electrical selector switches, and electrical proximity switches, or to incorporate the technique of the present disclosure in newly manufactured electrical wall switches and other switches. Further benefits of the present disclosure may include safety, security, and convenience.

Figure 1:
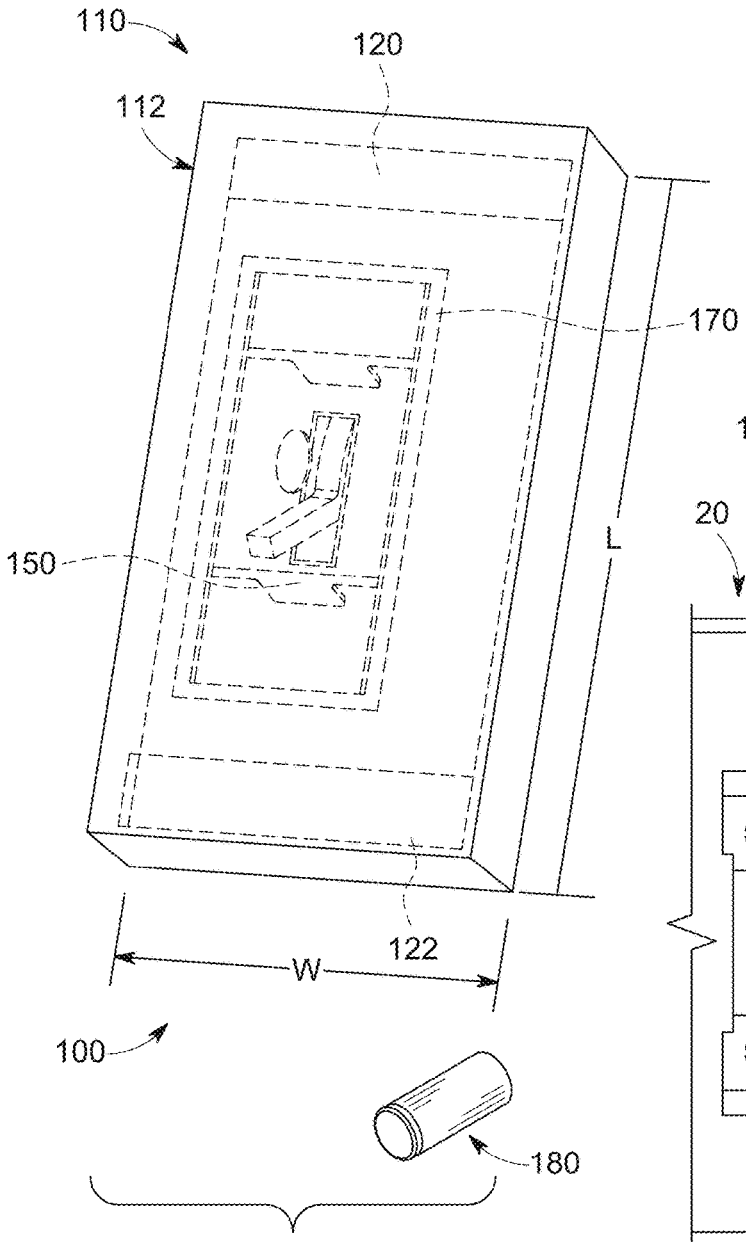
FIG. 1 is a perspective view of a protective cover assembly for magnetically actuating an electrical toggle wall switch, according to an embodiment of the present disclosure.
Figure 2:
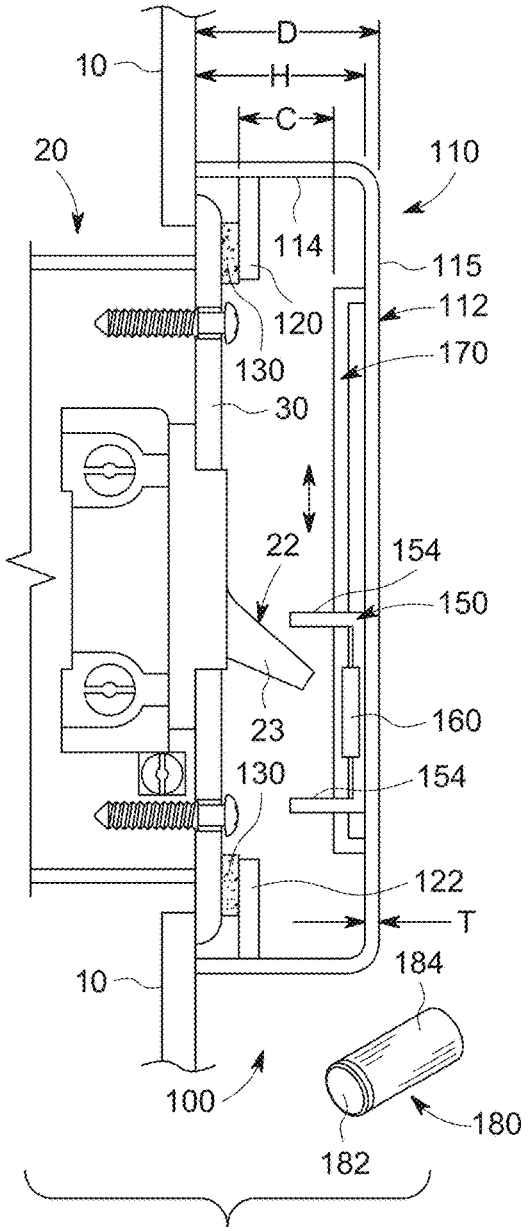
FIG. 2 is a side elevational view, in part cross-section, of the protective cover assembly for magnetically actuating the electrical toggle wall switch of FIG. 1, according to an embodiment of the present disclosure.
Figure 3:
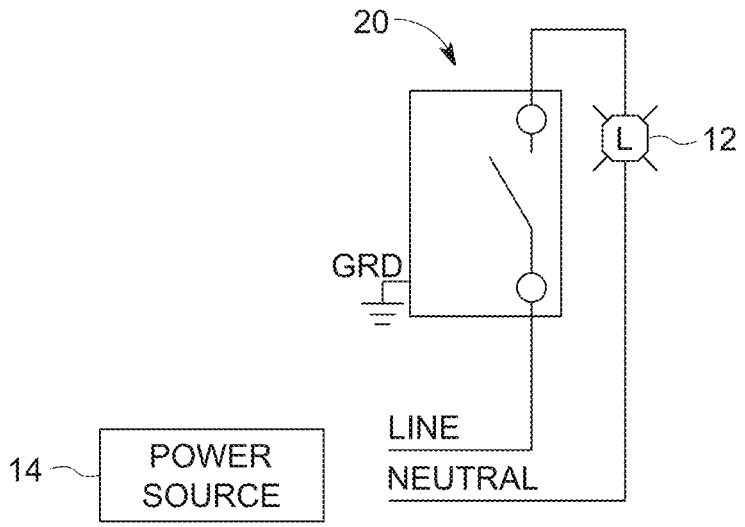
FIG. 3 is a diagrammatic illustration of an electrical toggle wall switch of FIG. 1 for controlling an electrical load, according to an embodiment of the present disclosure.

FIGS. 1 and 2 illustrate a protective cover assembly 100 for use in magnetically actuating an electrical toggle wall switch 20 (FIG. 2) disposed, for example, on a wall 10 (FIG. 2) according to an embodiment of the present disclosure. As shown in FIG. 3, electrical toggle wall switch 20 allows a user to control electrical power to a load 12 from an electrical power source 14 such as from a public electrical power utility. The electrical load 12 may be a light source such as a light bulb, a motor of an electric fan, or other electrical device.

With reference again to FIG. 2, the electrical toggle wall switch 20 may include an actuator 22 such as a toggle actuator having toggle lever 23, which toggle lever 23 is normally physically accessed, and contactable and actuatable by a user. The electrical toggle wall switch 20 may be covered with a wall switch plate 30 having an opening through which toggle lever 23 extends. As described in greater detail below, protective cover assembly 100 is operable so that the toggle lever 23 of the actuator 22 is movable, via a magnetic force and without the user physically accessing or contacting the toggle lever 23 of the actuator 22 for controlling electrical power from power source 14 (FIG. 3) to the electrical load 12 (FIG. 3).

In this illustrated embodiment, as shown in FIGS. 1 and 2, the protective cover assembly 100 may generally include an enclosure 110 and a tool 180. The enclosure 110 may include a sidewall 112 with an inner surface 114 (FIG. 2) and an outer surface 115 (FIG. 2). A plurality of cross members 120 and 122 may be operably attached to the inner surface 114 (FIG. 2) of the side wall 112. A connector 130 (FIG. 2) allows connecting the enclosure 110 over the electrical toggle wall switch 20 (FIG. 2) to inhibit a user from being able to physically access, physically contact, and physically actuate the toggle lever 23 (FIG. 2) of the actuator 22 (FIG. 2) of the electrical toggle wall switch 20 (FIG. 2). For example, connector 130 (FIG. 2) may be an adhesive, pressure sensitive tape, or double-sided tape for connecting the cross members 120 and 122 to an outer surface of wall switch plate 30 (FIG. 2).

Figure 4:
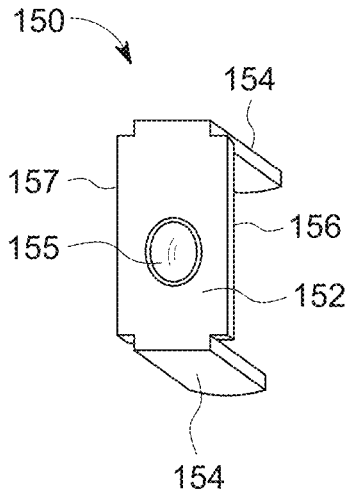
FIG. 4 is perspective view of the slider of the protective cover assembly of FIG. 1, according to an embodiment of the present disclosure.

In this illustrated embodiment, a slider 150 is slidably mounted within the enclosure 110 and selectively engageable with the toggle lever 23 (FIG. 2) of the actuator 20 (FIG. 2) of the electrical toggle wall switch 20 (FIG. 2). As shown in FIG. 4, slider 150 may be a generally C-shaped member having a web portion 152 and a pair of spaced-apart arms 154. The web portion 152 may be disposed adjacent to the inner surface 114 (FIG. 2), and the pair of spaced-apart arms 154 are operable for receiving toggle lever 23 (FIG. 2) of the toggle lever 23 (FIG. 2) of the actuator 22 (FIG. 2) therebetween.

Figure 5:
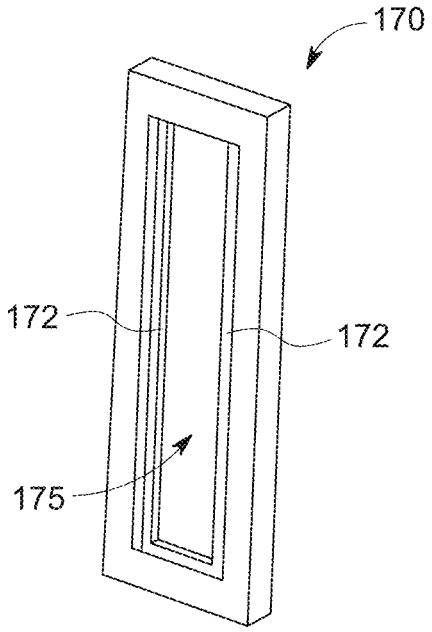
FIG. 5 is perspective view of the slider guide of the protective cover assembly of FIG. 1, according to an embodiment of the present disclosure.

With reference still to FIG. 4, the web portion 152 of the slider 150 may include a cavity 155 for receiving a first magnetic material member 160 (FIG. 2). As shown in FIG. 5, an elongated slider guide 170 (FIGS. 1 and 5) may be secured to the inner surface 114 (FIG. 2) of the enclosure 110 (FIGS. 1 and 2) for slidably restraining slider 150 (FIGS. 1 and 2). The slider guide 170 may include ridges 172 defining an elongated opening 175 having a width sized for receiving arms 154 (FIG. 4) therethrough. The ridges 172 may be sized for receiving and supporting edge portions 156 and 157 (FIG. 4) of slider 150 (FIG. 4) to maintain the slider 150 (as shown in FIG. 2) against the inner surface 114 (FIG. 2) of the enclosure 110 (FIG. 2). As described in greater detail below, the slider is movable between a first position and a second position along the inner surface of the enclosure.

With reference again to FIG. 2, the protective cover assembly 100 may include tool 180. The tool 180 may include a second magnetic material member 182 attached to a handle 184. The first magnetic material member 160 and the second magnetic material member 182 are operable to form a magnetic force therebetween. For example, one or both of the first magnetic material member 160 and the second magnetic material member 182 may be a magnet.

Figure 6:
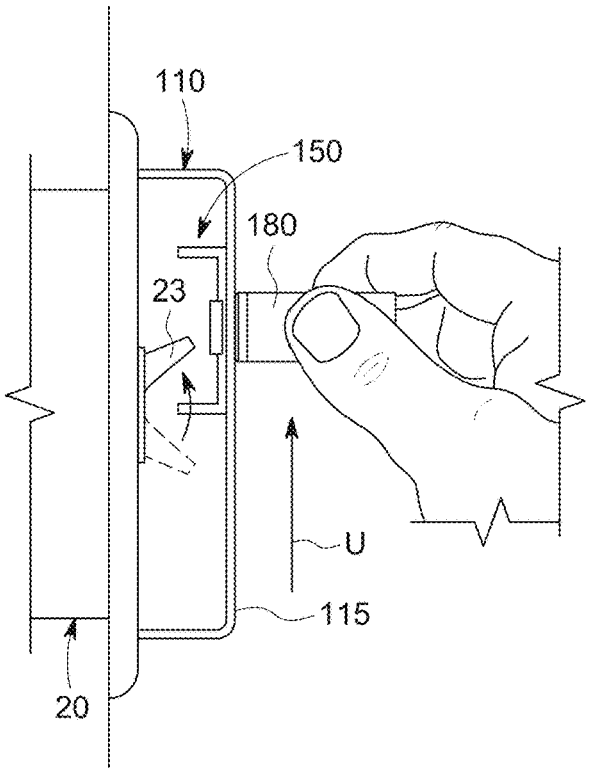
FIGS. 6 and 7 are side views, in part cross-section, illustrating operation of the protective cover assembly and the electrical toggle wall switch of FIGS. 1 and 2, according to an embodiment of the present disclosure.
Figure 7:
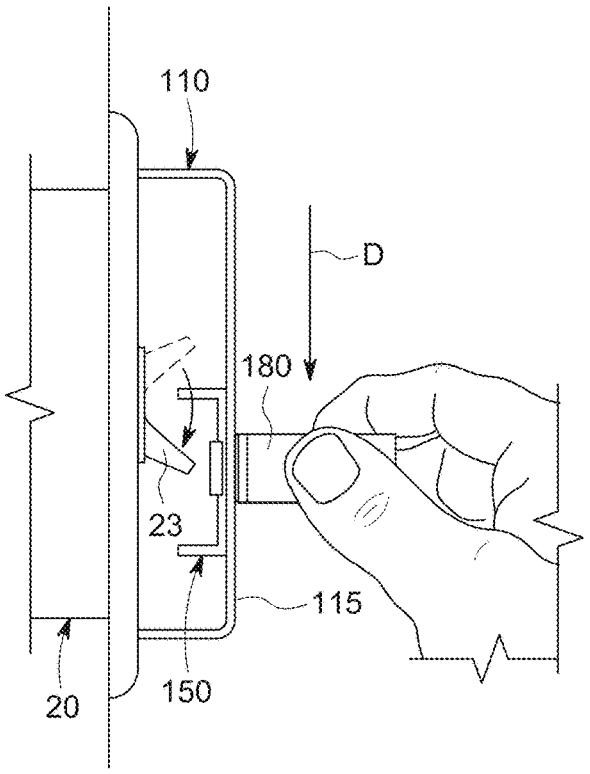

As shown in FIGS. 6 and 7, when a user moves the tool 180 in an axial direction such as vertically up in the direction of arrow U (FIG. 6) and down in the direction of arrow D (FIG. 7) along the outer surface 115 of the enclosure 110 covering the electrical toggle wall switch 20, the moving magnetic force acting through the enclosure 110 is operable to move the slider 150 from a lower position (shown in dashed lines in FIG. 6) to a raised position (shown in FIG. 6) or from a raised position (shown in dashed lines in FIG. 7) to a lower position (shown in FIG. 7) thereby moving the toggle lever 23 of the actuator 22 between a first position and a second position for controlling, such as turning ON and OFF, electrical power to the electrical load.

Figure 8:
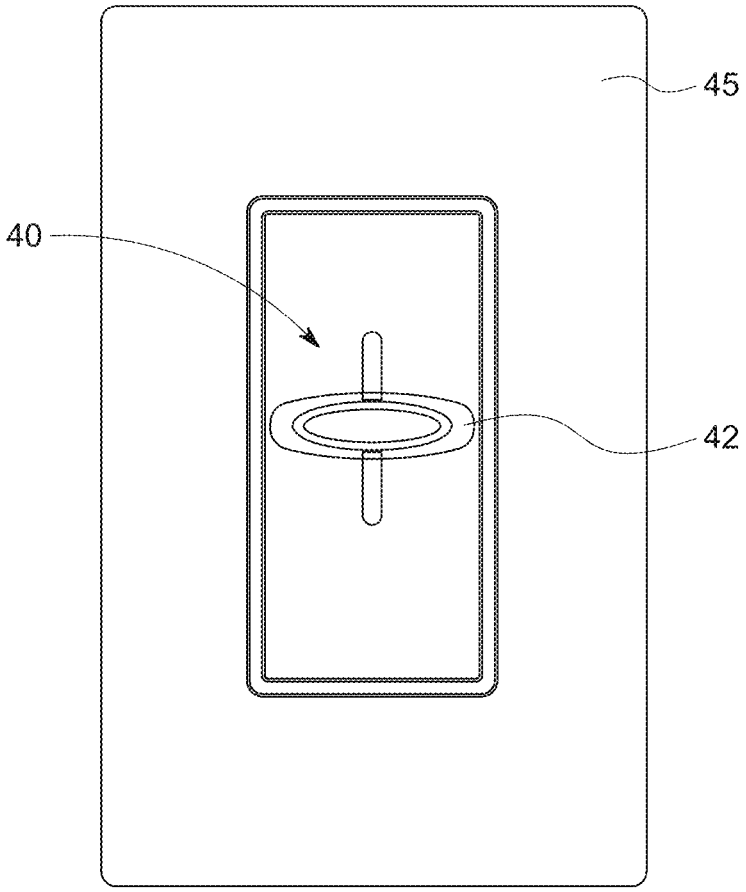
FIG. 8 is front elevation view of an electrical dimmer wall switch, according to an embodiment of the present disclosure.

FIG. 8 illustrates an electrical dimmer wall switch 40 and wall switch plate 45, according to an embodiment of the present disclosure. It will be appreciated that the protective cover assembly 100 (FIGS. 1 and 2) of the present disclosure may be operably used for inhibiting physical access and physical contact of an actuator 42 by a user, while allowing a user using a magnet force operable to adjust the dimmer wall switch for adjustably controlling the amount of power to a load such as a light source of a lighting fixture or to a motor of a fan. In other embodiment, the actuator of the dimmer switch may have a magnetic material member attached to the outer surface or include a magnetic material member disposed in the actuator of the dimmer switch, and operable similarly as described below.

Figure 9:
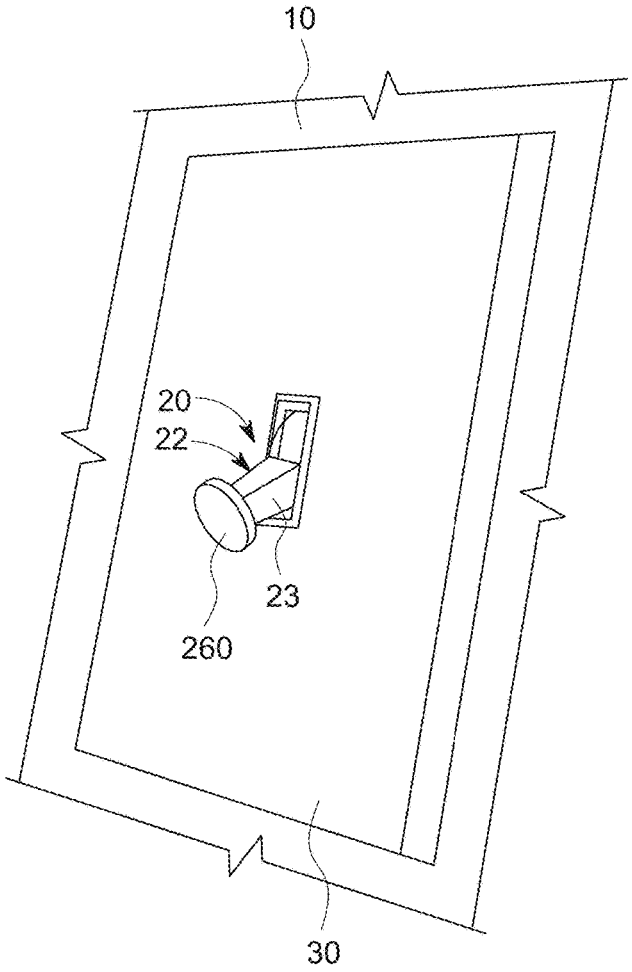
FIG. 9 is a perspective view of an electrical toggle wall switch with an attached magnetic material member, according to an embodiment of the present disclosure.
Figure 10:
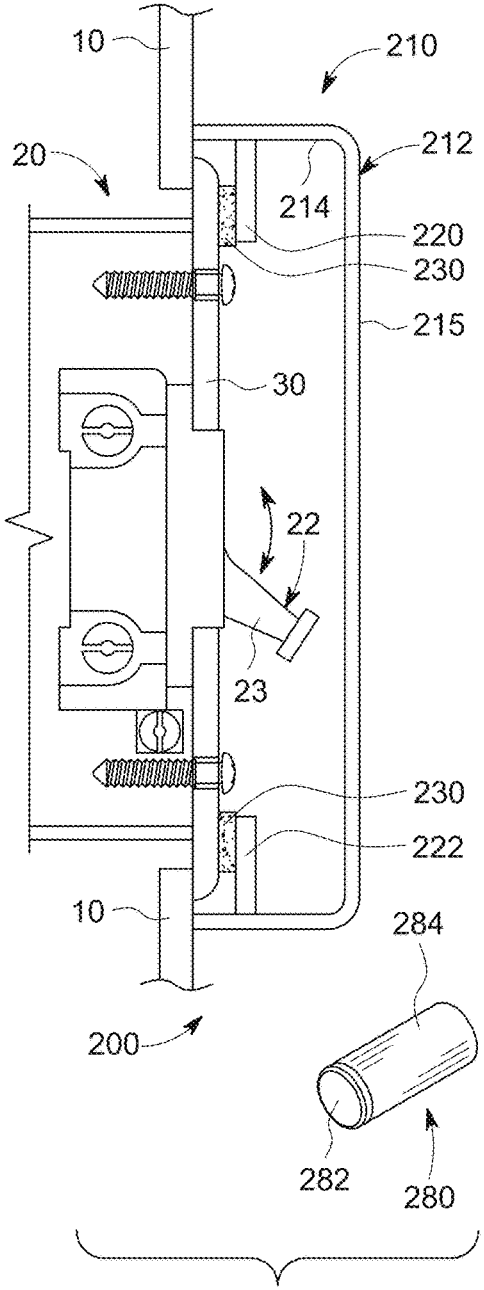
FIG. 10 is a side elevational view, in part cross-section, of a protective cover assembly for magnetically actuating the electrical toggle wall switch of FIG. 9, according to an embodiment of the present disclosure.

FIGS. 9 and 10 illustrate a protective cover assembly 200 (FIG. 10) for use in magnetically actuating an electrical toggle wall switch 20 disposed, for example, on a wall 10 according to an embodiment of the present disclosure. As shown in FIG. 3, electrical toggle wall switches 20 allows a user to control electrical power to a load 12 from an electrical power source 14 such as from a public electrical power utility. The electrical load 12 may be a light source such as a light bulb, a motor of an electric fan, or other electric device.

With reference again to FIG. 9, the electrical toggle wall switch 20 may include an actuator 22 such as a toggle actuator having toggle lever 23, which toggle lever 23 is normally physically accessible, contactable and actuatable by a user. The electrical toggle wall switch 20 may be covered with a wall switch plate 30 having an opening through which toggle lever 23 extends. As described in greater detail below, protective cover assembly 200 (FIG. 10) is operable so that the toggle lever 23 of the actuator 22 is movable, via a magnetic force and without the user physically contacting the toggle lever 23 of the actuator 22 for controlling electrical power from power source 14 (FIG. 3) to the electrical load 12 (FIG. 3).

In this illustrated embodiment, as shown in FIG. 10, the protective cover assembly 200 may include an enclosure 210 and a tool 280. The enclosure 210 may include a sidewall 212 with an inner surface 214 and an outer surface 215. A plurality of cross members 220 and 222 may be operably attached to the inner surface 214 of the side wall 212. A connector 230 allows connecting the enclosure 210 over the electrical toggle wall switch 20 to inhibit a user from being able to physically access, contact and actuate the toggle lever 23 of the actuator 22 of the electrical toggle wall switch 20. For example, connector 230 may be an adhesive, pressure sensitive tape, or double-sided tape for connecting cross members 220 and 222 to an outer surface of wall switch plate 30 (FIG. 9).

With reference again to FIG. 9, in this illustrated embodiment a first magnetic material member 260 is secured, for example, with a suitable adhesive or hot glue, or another suitable connector to an end of toggle handle 23.

With reference again to FIG. 10, the protective cover assembly 200 may include tool 280. The tool 280 may include a second magnetic material member 282 attached to a handle 284. The first magnetic material member 260 and the second magnetic material member 282 are operable to form a magnetic force therebetween. For example, one or both of the first magnetic material member 260 and the second magnetic material member 282 may be a magnet.

Figure 11:
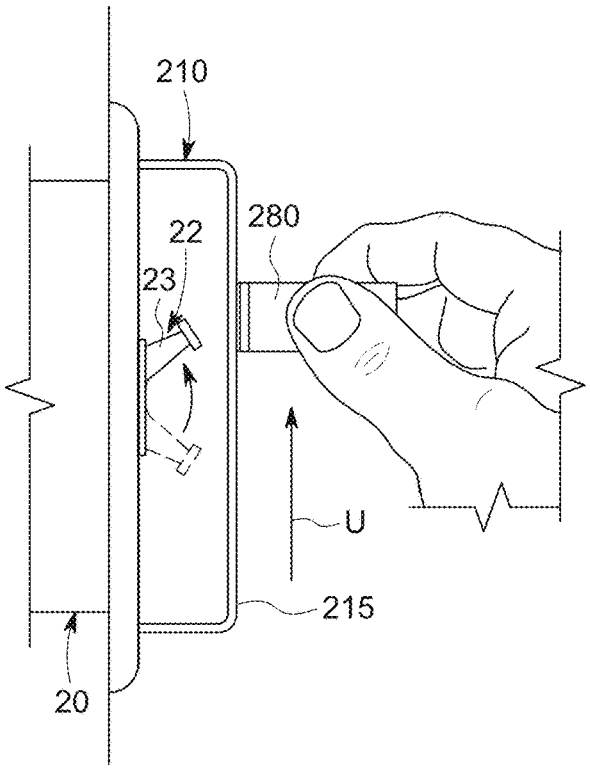
FIGS. 11 and 12 are side views, in part cross-section, illustrating operation of the protective cover assembly and the electrical toggle wall switch of FIG. 10, according to an embodiment of the present disclosure.
Figure 12:
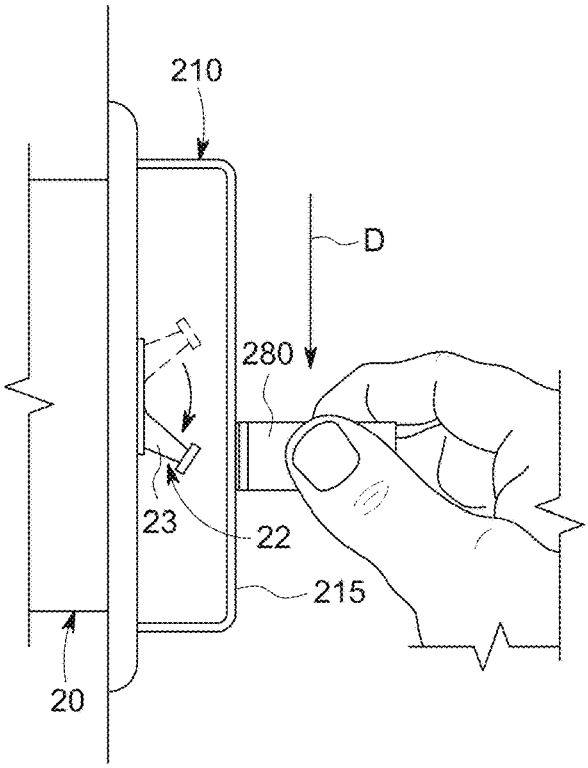

As shown in FIGS. 11 and 12, when a user moves the tool 280 in an axial direction such as vertically up in the direction of arrow U (FIG. 11) and down in the direction of arrow D (FIG. 12) along the outer surface 215 of the enclosure 210 covering the electrical toggle wall switch 20, the moving magnetic force acting through the enclosure 210 is operable to move the toggle lever 23 of the actuator 22 from a first position to a second position, and from the second position to the first position for controlling, such as turning ON and OFF, electrical power to the electrical load.

Figure 13:
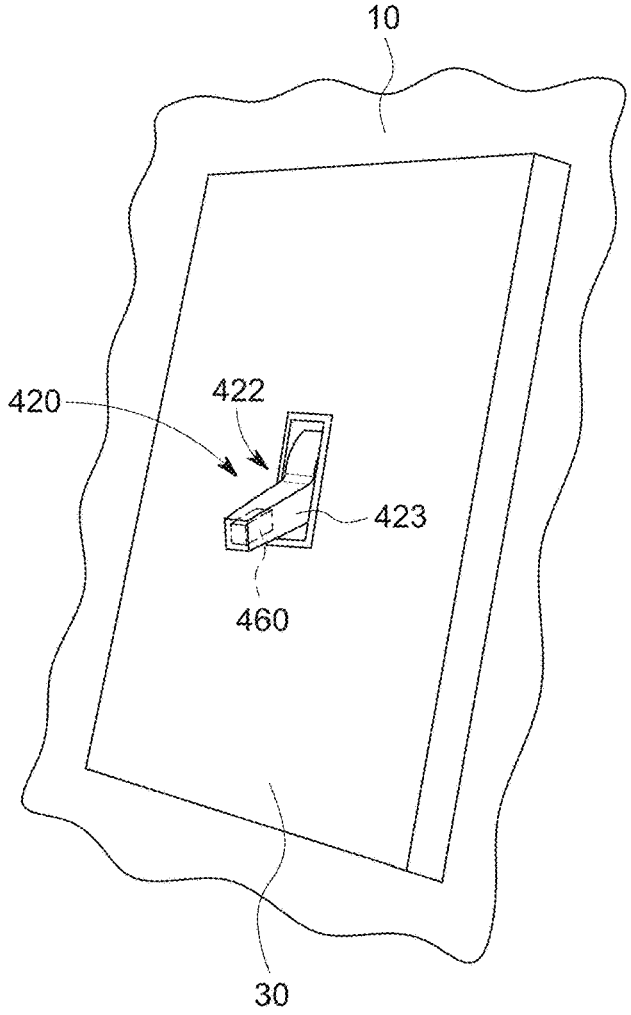
FIG. 13 is a perspective view of an electrical toggle wall switch, according to an embodiment of the present disclosure.
Figure 14:
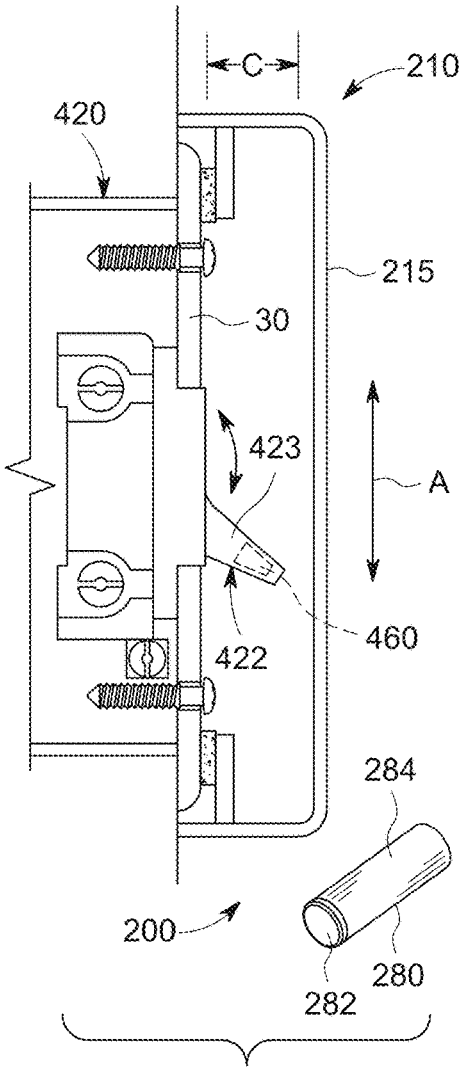
FIG. 14 is a side elevational view, in part cross-section, of a protective cover assembly for magnetically actuating the electrical toggle wall switch of FIG. 13, according to an embodiment of the present disclosure.

FIGS. 13 and 14 illustrate protective cover assembly 200 (FIG. 14) for use in magnetically actuating an electrical toggle wall switch 420 disposed, for example, on a wall 10 (FIG. 13) according to an embodiment of the present disclosure. Electrical toggle wall switch 420 allows a user to control electrical power to a load from an electrical power source such as from a public electrical power utility. The electrical load may be a light source such as a light bulb, a motor of an electric fan, or other electric device.

Electrical toggle wall switch 420 may include an actuator 422 such as a toggle actuator having toggle lever 423, which toggle lever 423 is normally accessible, contactable and actuatable by a user. The electrical toggle wall switch 420 may be covered with a wall switch plate 30 having an opening through which toggle lever 423 extends. As described in greater detail below, protective cover assembly 200 (FIG. 14) is operable so that the toggle lever 423 of the actuator 422 is movable, via a magnetic force and without the user physically contacting the toggle lever 423 of the actuator 422 for controlling electrical power from the power source to the electrical load.

In this illustrated embodiment, a first magnetic material member 460 may be disposed inside or within toggle lever 423, for example, with a suitable adhesive or hot glue, other suitable connector, or molded therein.

With reference again to FIG. 14, the protective cover assembly 200 may include tool 280. The tool 280 may include the second magnetic material member 282 attached to the handle 284. The first magnetic material member 460 and the second magnetic material member 282 are operable to form a magnetic force therebetween. For example, one or both of the first magnetic material member 260 and the second magnetic material member 482 may be a magnet. When the tool 280 is moved in an axial direction such as vertically up and down in the direction of double-headed arrow A along the outer surface 215 of the enclosure 210 covering the electrical toggle wall switch 420, the moving magnetic force acting through the enclosure 210 is operable to move the toggle lever 423 of the actuator 422 from a first position to a second position and vice versa for controlling, such as turning ON and OFF, electrical power to the electrical load. In other embodiments, one or more magnetic material members may be disposed in the shoulders of the toggle, e.g., to the sides of the toggle lever.

Figure 15:
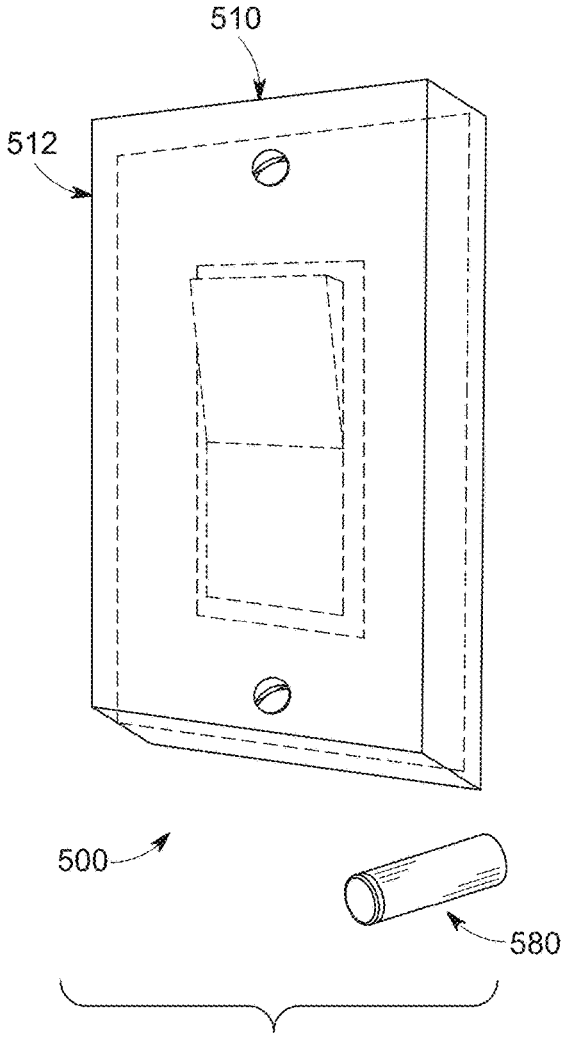
FIG. 15 is a perspective view of a protective cover assembly for magnetically actuating an electrical rocker wall switch, according to an embodiment of the present disclosure.
Figure 16:
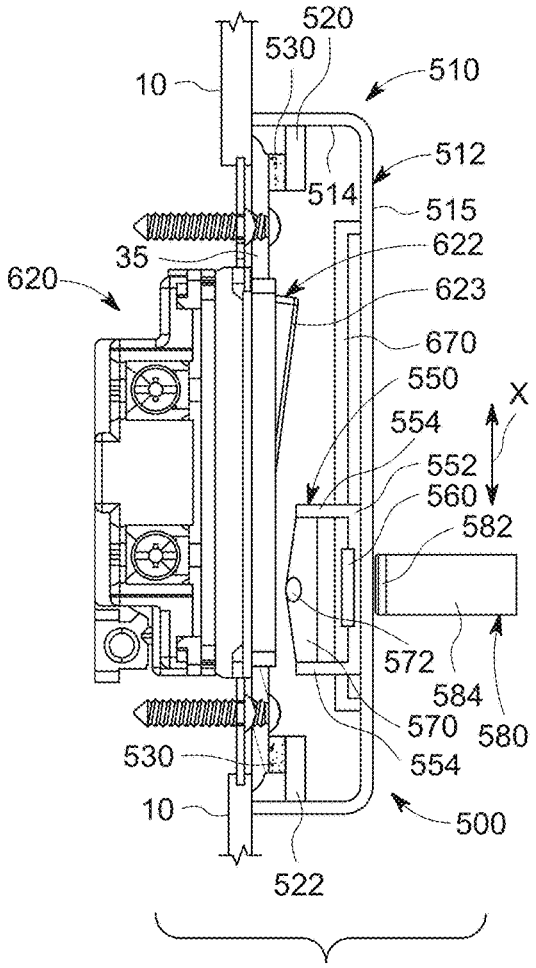
FIG. 16 is a side elevational view, in part cross-section, of the protective cover assembly for magnetically actuating the electrical rocker wall switch of FIG. 15, according to an embodiment of the present disclosure.

FIGS. 15 and 16 illustrate a protective cover assembly 500 for use in magnetically actuating an electrical rocker wall switch 620 (FIG. 16) disposed, for example, on a wall 10 (FIG. 16) according to an embodiment of the present disclosure. Electrical rocker wall switch 620 allows a user to control electrical power to a load from an electrical power source such as from a public electrical power utility. The electrical load may be a light source such as a light bulb, a motor of an electric fan, or other electric device.

With reference to FIG. 16, the electrical rocker wall switch 620 may include an actuator 622 such as a rocker actuator having rocker surface 623, which rocker 623 is normally physically accessible, contactable and actuatable by a user. The electrical rocker wall switch 620 may be covered with a wall switch plate 35 having an opening through which rocker 623 extends. As described in greater detail below, protective cover assembly 500 is operable so that the rocker 623 of the actuator 622 is movable, via a magnetic force and without the user physically contacting the rocker 623 of the actuator 622 for controlling electrical power from a power source to an electrical load.

In this illustrated embodiment, as shown in FIGS. 15 and 16, the protective cover assembly 500 may generally include an enclosure 510 and a tool 580. The enclosure 510 may include a sidewall 512 with an inner surface 514 (FIG. 16) and an outer surface 515 (FIG. 16). A plurality of cross members 520 and 522 (FIG. 16) may be operably attached to the inner surface 514 (FIG. 16) of the side wall 512. A connector 530 (FIG. 16) allows connecting the enclosure 510 over the electrical rocker wall switch 620 (FIG. 16) to inhibit a user from being able to physically access, contact, and actuate the rocker 623 (FIG. 16) of the actuator 622 (FIG. 16) of the electrical rocker wall switch 20 (FIG. 16). For example, connector 530 (FIG. 16) may be an adhesive, pressure sensitive tape, or double-sided tape for connector cross members 520 and 522 (FIG. 16) to an outer surface of wall switch plate 35 (FIG. 16).

In this illustrated embodiment, a slider 550, as shown in FIG. 16, is slidably mounted within the enclosure 510 and selectively engageable with the rocker 623 of the actuator 620 of the electrical rocker wall switch 620. Slider 550 may be a generally C-shaped member having a web portion 552, a pair of spaced-apart arms 554, and a first magnetic material member 560, which slider 550 may be essentially similar to slider 150 described above. The web portion may be disposed adjacent to the inner surface 514 (FIG. 2) and supported by a guide 670, which guide may be essentially similar to guide 170 (FIG. 4). The pair of spaced-apart arms are operable for receiving therebetween an adapter or support 570 and roller 572. In some embodiments, support 570 may be releasably attachable to the arms or may be fixedly attached to the arms. Support 570 being releasably attachable such as in a snap fit manner, or fixedly attachable such using an adhesive, allows a user to essentially use the same protective cover assembly either for an electrical rocker wall switch or for an electrical toggle wall switch. For example, the support and roller may be provided, and a user may select to use the support and the roller when employing the protective cover assembly over an electrical rocker wall switch. As described in greater detail below, the slider is movable between a first position and a second position along the inner surface of the enclosure.

With reference still to FIG. 16, the protective cover assembly 500 may include tool 580. The tool 580 may include a second magnetic material member 582 attached to a handle 584. The first magnetic material member 560 and the second magnetic material member 582 are operable to form a magnetic force therebetween. For example, one or both of the first magnetic material member 560 and the second magnetic material member 582 may be a magnet.

When the tool 580 is moved in an axial direction such as vertically up and down in the direction of arrow X along the outer surface 515 of the enclosure 510 covering the electrical rocker wall switch 620, the moving magnetic force acting through the enclosure 510 is operable to move the slider 550 from a lower position (shown in FIG. 16) to a raised position (not shown in FIG. 16) so that the roller 572 engages and trips the rocker 623 or from a raised position (not shown in FIG. 16) to a lower position (shown in FIG. 16) so that the roller 572 engages and trips the rocker thereby moving the rocket 623 of the actuator 622 from a first position to a second position, and vice versa, for controlling, such as turning ON and OFF, electrical power to the electrical load. In other embodiments, the support or adapter need not include a roller, and instead may include a rounded portion for engaging the rocker.

Figure 17:
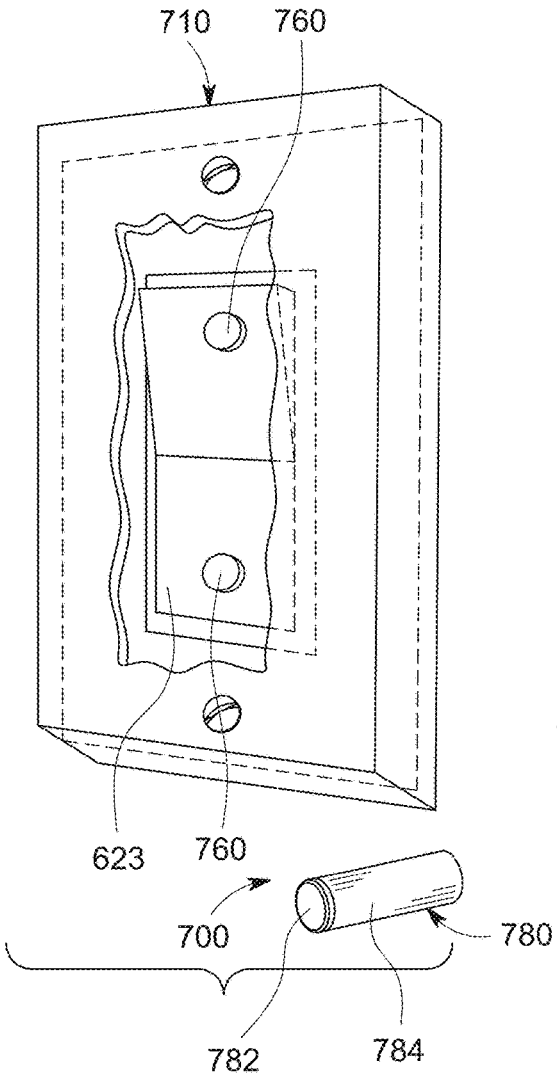
FIG. 17 is a perspective view, partial cutaway, of a protective cover assembly for magnetically actuating an electrical rocker wall switch, according to an embodiment of the present disclosure.
Figure 18:
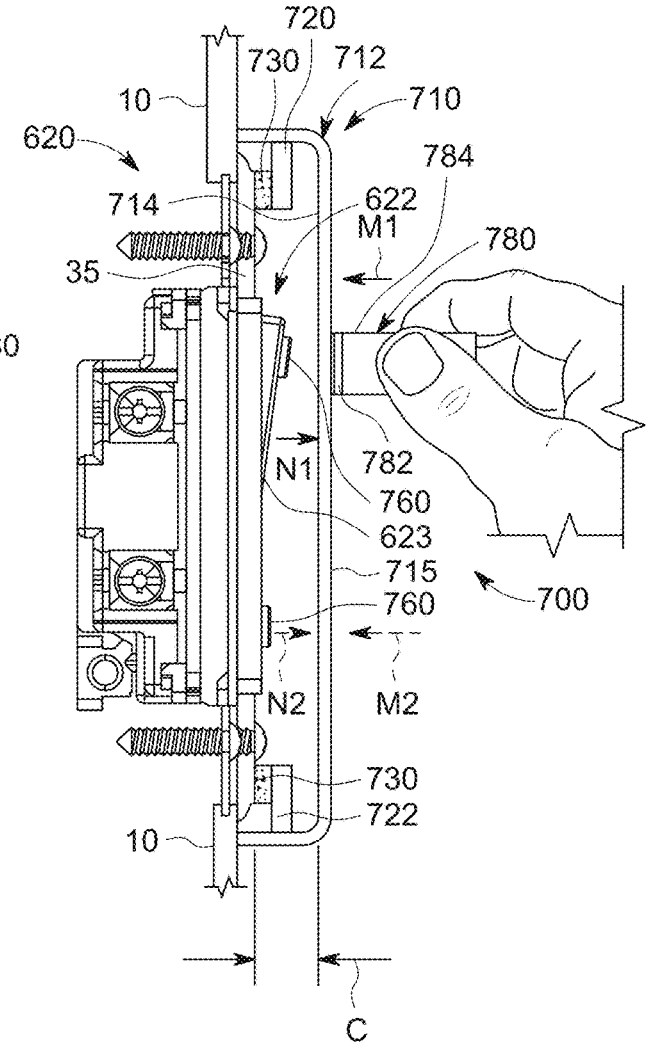
FIG. 18 is a side elevational view, in part cross-section, of the protective cover assembly for magnetically actuating the electrical rocker wall switch of FIG. 17, according to an embodiment of the present disclosure.

FIGS. 17 and 18 illustrate a protective cover assembly 700 for use in magnetically actuating an electrical rocker wall switch 620 disposed, for example, on a wall 10 (FIG. 18) according to an embodiment of the present disclosure. Electrical rocker wall switches 620 allows a user to control electrical power to a load from an electrical power source such as from a public electrical power utility. The electrical load may be a light source such as a light bulb, a motor of an electric fan, or other electric device.

With reference to FIG. 18, the electrical rocker wall switch 620 may include an actuator 622 such as a rocker actuator having rocker surface 623, which rocker 623 is normally physically accessible, contactable and actuatable by a user. The electrical rocker wall switch 620 may be covered with a wall switch plate 35 having an opening through which rocker 623 extends. As described in greater detail below, protective cover assembly 700 is operable so that the rocker 623 of the actuator 622 is movable, via a magnetic force and without the user physically contacting the rocker 623 of the actuator 622 for controlling electrical power from a power source to an electrical load.

In this illustrated embodiment, the protective cover assembly 700 may include an enclosure 710 and a tool 780. The enclosure 710 may include a sidewall 712 with an inner surface 714 and an outer surface 715. A plurality of cross members 720 and 722 may be operably attached to the inner surface 714 of the side wall 712. A connector 730 allows connecting the enclosure 710 over the electrical rocker wall switch 620 to inhibit a user from being able to physically access, contact and actuate the rocker 623 of the actuator 622 of the electrical rocker wall switch 620. For example, connector 730 may be an adhesive, pressure sensitive tape, or double-sided tape for connector cross members 720 and 722 to an outer surface of wall switch plate 35.

With reference again to FIG. 17, in this illustrated embodiment a pair of first magnetic material members 760 is secured, for example, with a suitable adhesive or hot glue, or other suitable connector to opposite ends of the rocker 623. The protective cover assembly 700 may include tool 780. The tool 780 may include a second magnetic material member 782 attached to a handle 784. The first magnetic material member 760 and the second magnetic material member 782 are operable to form a magnetic force therebetween. For example, one or both of the first magnetic material member 760 and the second magnetic material member 782 may be a magnet.

As shown in FIG. 18, when the tool 780 is moved toward the outer surface 715 of the enclosure 710 covering the electrical rocker switch 620 and brought into proximity and adjacent to the upper first magnetic material member 760 in the direction of arrow M1, a magnetic force acting through the enclosure 710 is operable to move the upper half of the rocker 623 of the actuator 622 in a direction of arrow N1 from a first position (not shown in FIG. 18) to a second position (shown in FIG. 18) for controlling, such as turning ON or OFF, electrical power to the electrical load. When the tool 780 is moved toward the outer surface 715 of the enclosure 710 covering the electrical rocker switch 620 and brought into proximity and adjacent to the lower first magnetic material member 760 in the direction of arrow M2, a magnetic force acting through the enclosure 710 is operable to move the lower half of the rocker 623 of the actuator 622 in a direction of arrow N2 from the second position (shown in FIG. 18) to the first position (not shown in FIG. 18) for controlling, such as turning OFF or ON, electrical power to the electrical load. It will be appreciated that the above described operation includes an attractive magnetic force for moving the rocker. In other embodiments, the magnetic members may be selected so that a repulsive magnetic force is operable for moving the rocker.

Figure 19:
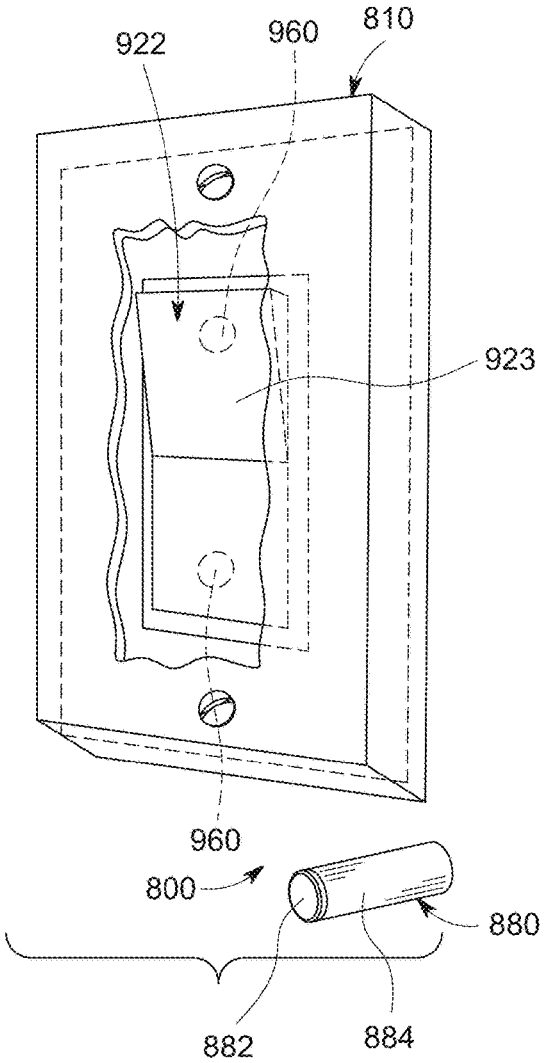
FIG. 19 is a perspective view, partial cutaway, of a protective cover assembly for magnetically actuating an electrical rocker wall switch, according to an embodiment of the present disclosure.
Figure 20:
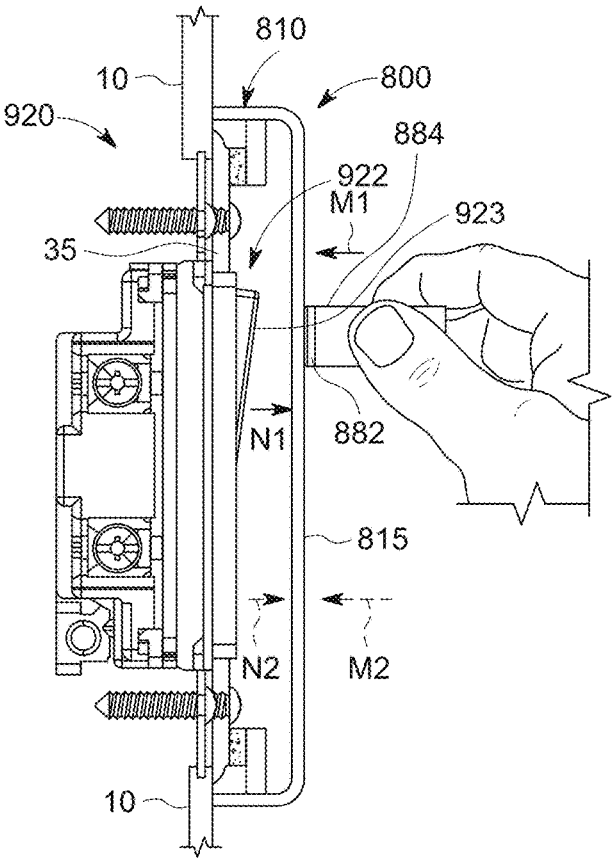
FIG. 20 is a side elevational view, in part cross-section, of the protective cover assembly for magnetically actuating the electrical rocker wall switch of FIG. 19, according to an embodiment of the present disclosure.

FIGS. 19 and 20 illustrate a protective cover assembly 800 for use in magnetically actuating an electrical rocker wall switch 920 (FIG. 20) disposed, for example, on a wall 10 (FIG. 20) according to an embodiment of the present disclosure. Electrical rocker wall switches 920 (FIG. 20) allows a user to control electrical power to a load from an electrical power source such as from a public electrical power utility. The electrical load may be a light source such as a light bulb, a motor of an electric fan, or other electric device.

As shown in FIG. 20, electrical rocker wall switch 920 may include an actuator 922 such as a rocker actuator having rocker surface 923, which rocker 922 is normally physically accessible, contactable and actuatable by a user. The electrical rocker wall switch 920 may be covered with a wall switch plate 35 having an opening through which rocker surface 923 extends. As described in greater detail below, protective cover assembly 800 is operable so that the rocker surface 923 of the actuator 922 is movable, via a magnetic force and without the user physically contacting the rocker surface 923 of the actuator 922 for controlling electrical power from a power source to an electrical load.

With reference again to FIG. 19, in this illustrated embodiment, a pair of first magnetic material members 960 may be disposed inside or within rocker 922, for example, with a suitable adhesive or hot glue, other suitable connector attachment, or molded therein, or suitable attachment.

The protective cover assembly 800 may include a tool 880. The tool 880 may include the second magnetic material member 882 attached to the handle 884. The first magnetic material member 960 and the second magnetic material member 882 are operable to form a magnetic force therebetween. For example, one or both of the first magnetic material member 960 and the second magnetic material member 882 may be a magnet.

Figure 21:
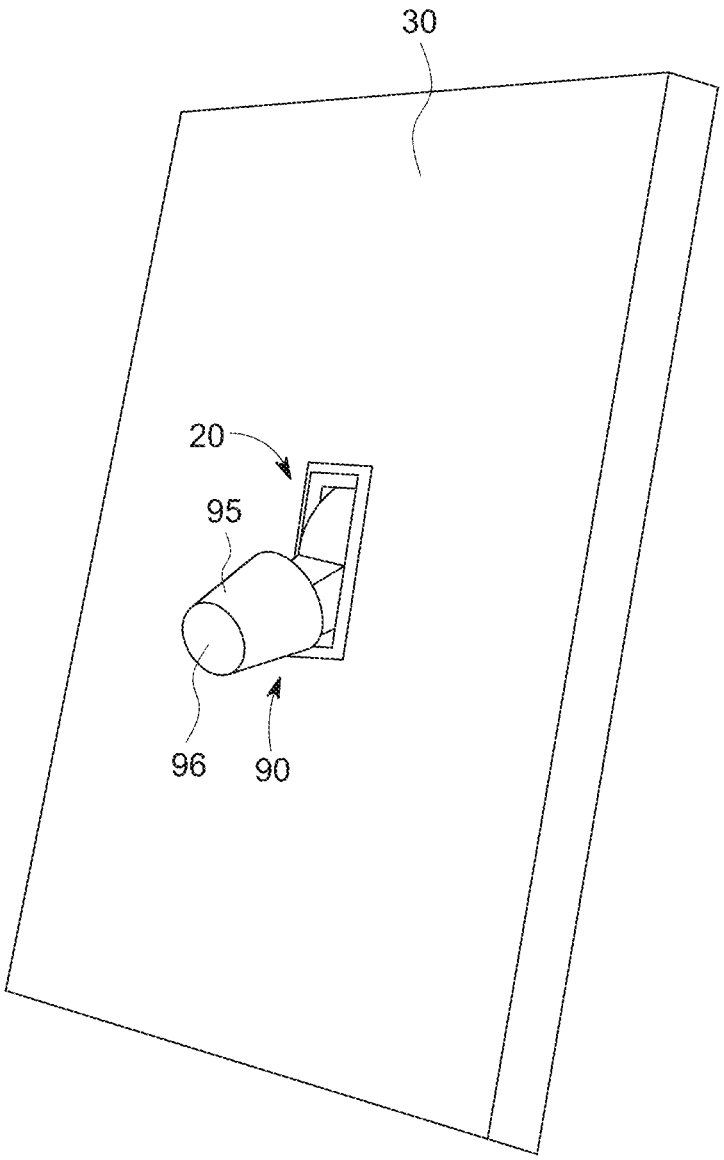
FIG. 21 is a perspective view of a magnetic material member attached to an electrical toggle wall switch, according to an embodiment of the present disclosure.

As shown in FIG. 20, when the tool 880 is moved toward an outer surface 815 of the enclosure 810 covering the electrical rocker switch 920 and brought into proximity and adjacent to the upper first magnetic material member 960 in the direction of arrow M1, a magnetic force acting through the enclosure 810 is operable to move the upper half of the rocker 923 of the actuator 922 in a direction of arrow N1 from a first position (not shown in FIG. 20) to a second position (shown in FIG. 20) for controlling, such as turning ON or OFF, electrical power to the electrical load. When the tool 880 is moved toward the outer surface 815 of the enclosure 810 covering the electrical rocker switch 920 and brought into proximity and adjacent to the lower first magnetic material member 960 in the direction of arrow M2, a magnetic force acting through the enclosure 810 is operable to move the lower half of the rocker 823 of the actuator 822 in a direction of arrow N2 from the second position (shown in FIG. 20) to the first position (not shown in FIG. 20) for controlling, such as turning OFF or ON, electrical power to the electrical load. It will be appreciated that the above described operation includes an attractive magnetic force for moving the rocker. In other embodiments, the magnetic members may be selected so that a repulsive magnetic force is operable for moving the rocker, FIG. 21 illustrates the electrical toggle wall switch 20, the wall switch plate 30, and a cap 90, according to an embodiment of the present disclosure. The cap 90 may include a magnetic material member 96, and a surrounding wall 95. Surrounding wall 95 may include a cavity (not shown in FIG. 21) sized for receiving the distal end portion of the toggle of the electrical toggle wall switch 20. Cap 90 may be connected to the distal end of the toggle using an adhesive or other attachment or connector means. Toggle electrical toggle wall switch 20 may be operable with the above protective wall switch plates.

Figure 22:
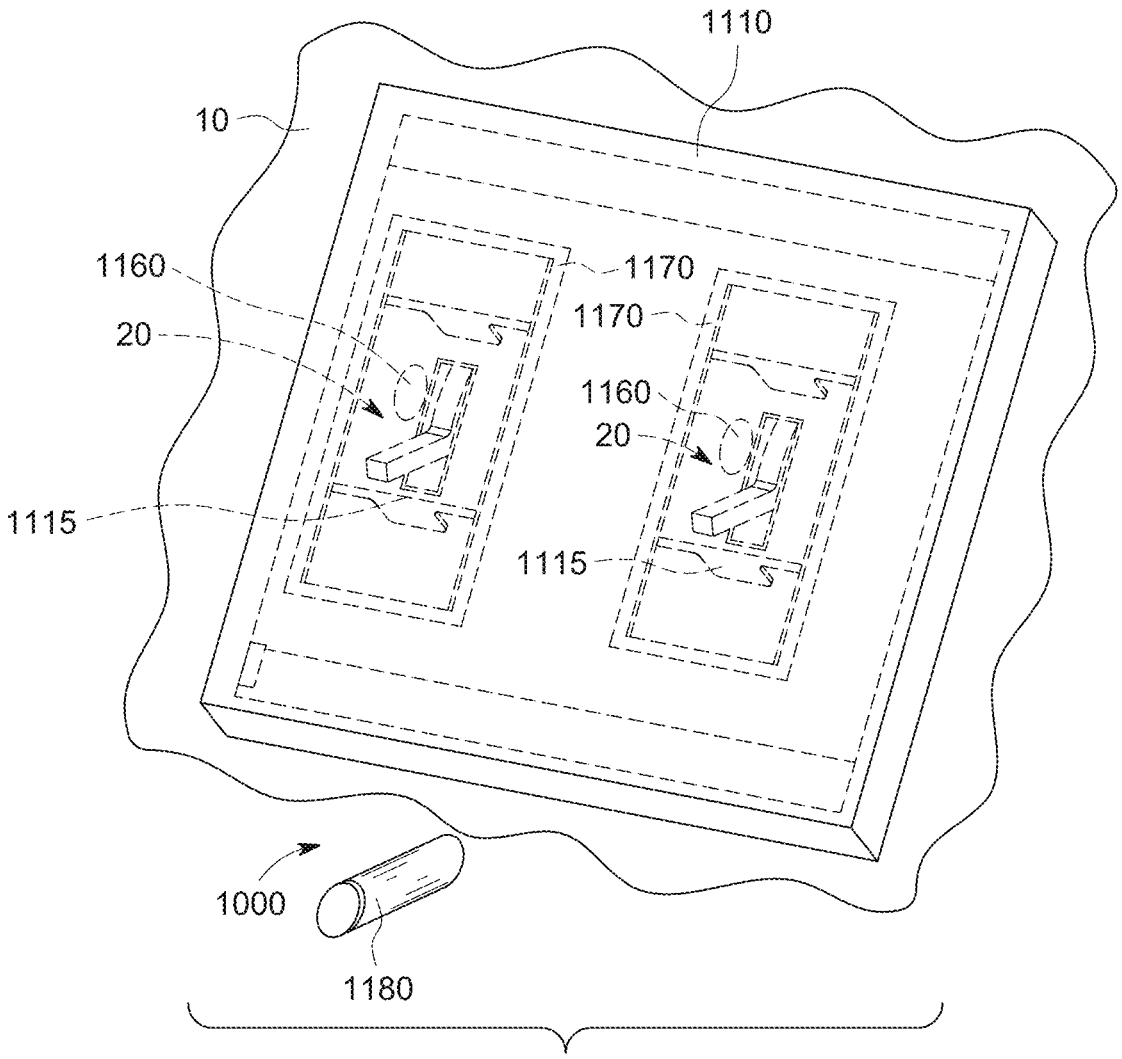
FIG. 22 is a perspective view of a protective cover assembly for controlling a plurality of electrical toggle wall switch, according to an embodiment of the present disclosure.

FIG. 22 illustrates a protective cover assembly 1000 for use in magnetically actuating a plurality of electrical toggle wall switches 20 disposed, for example, on a wall 10, according to an embodiment of the present disclosure. As shown in FIG. 22, electrical toggle wall switches 20 allows a user to control electrical power to a plurality of loads from an electrical power source such as from a public electrical power utility. The electrical loads may be light sources such as one or more light bulbs, one or more motors for electric fans, or other electrical devices. In this illustrated embodiment, as shown in FIG. 22, the protective cover assembly 1000 may generally include an enclosure 1110, a plurality of sliders 1115, a plurality of magnetic material member 1160 a plurality of guides 1170, and a tool 1180. The enclosure 1110 may be essentially the same as enclosure 110 (FIG. 2) with the exception of being sized to extend over an electrical wall switch plate having openings for a plurality of electrical wall switches. The plurality of sliders 1115, the plurality of guides 1170, and the tool 1180 may be essentially the same the slider 115 (FIG. 4), the magnetic material member 160 (FIG. 2), the guide 170 (FIG. 5), and the tool 180 (FIG. 2). It will be appreciated that the other embodiments of the present disclosure described may also be configured for controlling two or more electrical wall switches.

Figure 23:
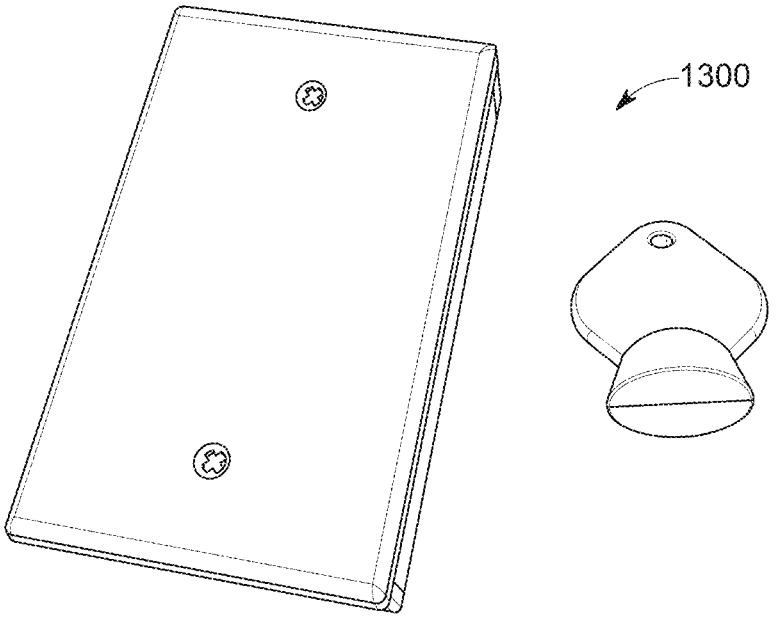
FIGS. 23 and 24 are perspective views of a protective cover assembly for controlling an electrical toggle wall switches, according to an embodiment of the present disclosure.
Figure 24:
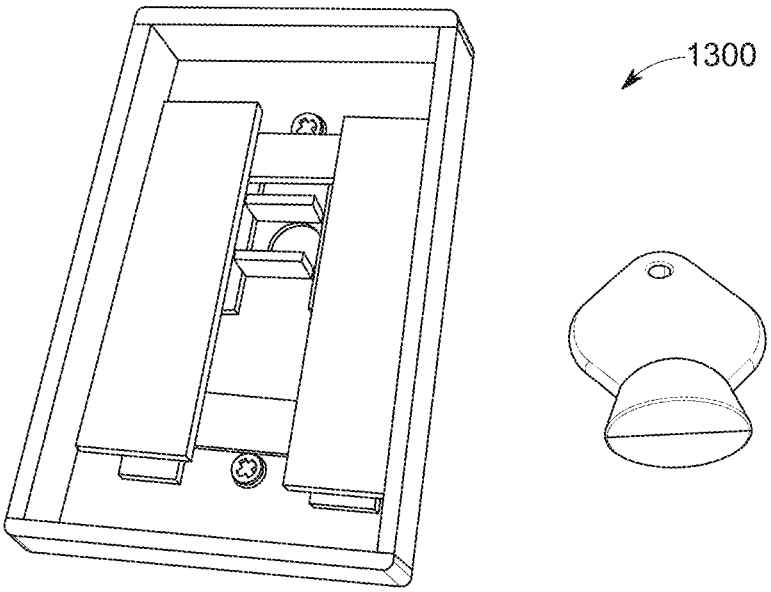

FIGS. 23 and 24 illustrate a protective cover assembly 1300 for controlling an electrical toggle wall switches, according to an embodiment of the present disclosure.

In some of the various embodiments, the enclosure may have a front wall disposable over the actuator of the electrical wall switch and a surrounding sidewall extending towards the electrical wall switch or electrical wall switch plate. In some of the embodiments of the protective cover assembly, the plurality of cross-members may be set back from the opening defined by the sidewall. In some embodiments, the enclosure may have a rectangular front sidewall, a surrounding sidewall having a horizontal top side wall, a horizontal bottom sidewall, a right vertical sidewall, and a left vertical sidewall defining a rectangular opening that faces the wall. As shown in FIG. 1, the enclosure 110 may have an outer width W, a length L, and a depth D (FIG. 2). An internal height H may be sufficient to provide a sufficient clearance C for movement of the actuator. The enclosure sidewall may have a thickness T of about 1/16 inch to about 1/4 inch, or about 1/8 inch, about 3/16 inch, or other suitable thickness. For example, in the various embodiments generally the overall configuration of the enclosure may have a width between about 2.7 inches and about 3.5 inches, and a length between about 4.5 inches to about 5.5 inches, or other suitable sizes. For example, the width may be about 2.7 inches and the length may be about 4.5 inches such as for use with standard size switch plates. In other embodiments, the width may be about 3.5 inches and the length may be about 5.5 inches such as for use with oversized switch plates. The depth may be about 0.5 inch to about 1.5 inch, or about 0.75 inch, about 1 inch, 1.3 inches, or 1.5 inches, or other suitable depths. In other embodiment, s the enclosure may be sized to attach directly to the wall. In other embodiment, the enclosure may extend over the actuator and only a portion of the switch plate. In still other embodiments, the front facing portion of the enclosure, e.g., generally vertical surface that faces a user, may be curved such as curved outwardly towards the user, or may have any suitable configuration. In embodiments with a slider, the slider guide and slider may also be curved to slide along the inner curved surface of the enclosure.

In some embodiments, the enclosure may extend entirely and completely over and around the actuator of the electric wall switch preventing a user from physically touching or using an object such as a pencil from touching the actuator. The sidewalls of the enclosure may be formed as a single monolithic structure, formed from separate pieces adhered with adhesive or ultrasonically welded together, or otherwise attached. The enclosure may be formed from a polymeric or plastic material. The enclosure may be opaque, translucent, or transparent, and be clear or have a color. Colors may include white, black, brown, tan, bronze, brass, wood or other suitable colors.

In some of the various embodiments, the first magnetic material member may include a magnet, and the second magnetic material member of the tool may include at least one of a magnet and a metal. In some embodiments, the second magnetic material member of the tool may include a magnet, and the first magnetic material member may include at least one of a magnet and a metal. In some embodiments, the first magnetic material member may include a magnet, and the second magnetic material member of the tool may include a magnet. In some embodiments, the slider and the first magnetic material member may include a monolithic one-piece slider formed from a magnetic material. The magnetic material members may be samarium-cobalt rare earth magnets, rare earth neodymium magnets nickel plated to resist corrosion. The magnets may be disc-shaped having a thickness and a diameter, cube-shaped, or other suitable shapes. For example, the one or more magnets may be disc-shaped having a diameter, a thickness, and a holding force as set forth in Table 1 below.

TABLE 1

| Diameter (inches) | Thickness (inches) | Holding Force (lbs) |
|---|---|---|
| 0.125 | 0.125 | 0.84 |
| 0.125 | 0.250 | 1.05 |
| 0.187 | 0.187 | 2.26 |
| 0.187 | 0.375 | 2.46 |
| 0.187 | 0.062 | 0.92 |
| 0.187 | 0.125 | 1.69 |
| 0.187 | 0.250 | 2.43 |
| 0.250 | 0.062 | 1.46 |
| 0.250 | 0.125 | 2.85 |
| 0.250 | 0.187 | 3.71 |
| 0.250 | 0.250 | 4.15 |
| 0.312 | 0.125 | 4.14 |
| 0.312 | 0.187 | 5.43 |
| 0.312 | 0.250 | 6.30 |
| 0.312 | 0.375 | 7.12 |
| 0.375 | 0.060 | 2.50 |
| 0.375 | 0.187 | 7.18 |

It will be appreciated that other suitable magnets and shapes may be suitably employed. For example, the holding force of the magnets may range from about 0.1 pounds (lbs) to about 10 lbs, about 0.25 lbs to about 7 lbs, about 0.5 lbs to about 5 lbs, about 0.75 lbs to about 3 lbs.

In some of the various embodiments, the at least one first magnetic material member may include an adhesive layer having a first surface attached to the at least one first magnetic material member, and a release layer attached to a second surface of the adhesive layer.

In the various embodiments of the electrical wall switches, the actuator may have a magnetic material member disposed in the actuator below an outer surface of the actuator. The magnetic material member may be a magnet or a metal.

Figure 25:
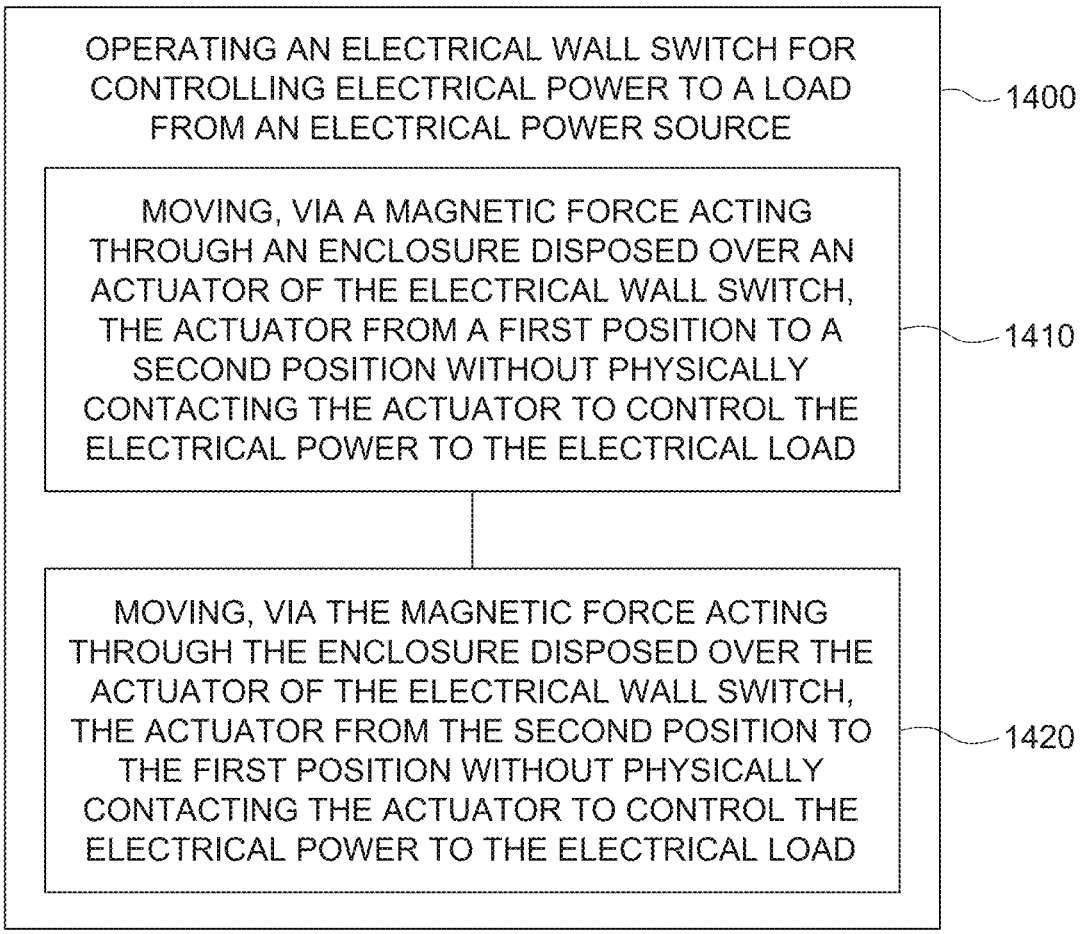
FIG. 25 is a flowchart of a method for operating an electrical wall switch for controlling electrical power to a load from an electrical power source, according to embodiment of the present disclosure.

FIG. 25 illustrates a method 1400 for operating an electrical wall switch for controlling electrical power to a load from an electrical power source, according to embodiment of the present disclosure. The method 1400 includes at 1410 moving, via a magnetic force acting through an enclosure disposed over an actuator of the electrical wall switch, the actuator from a first position to a second position without physically contacting the actuator to control the electrical power to the electrical load; and at 1420 moving, via the magnetic force acting through the enclosure disposed over the actuator of the electrical wall switch, the actuator from the second position to the first position without physically contacting the actuator to control the electrical power to the electrical load.

Figure 26:
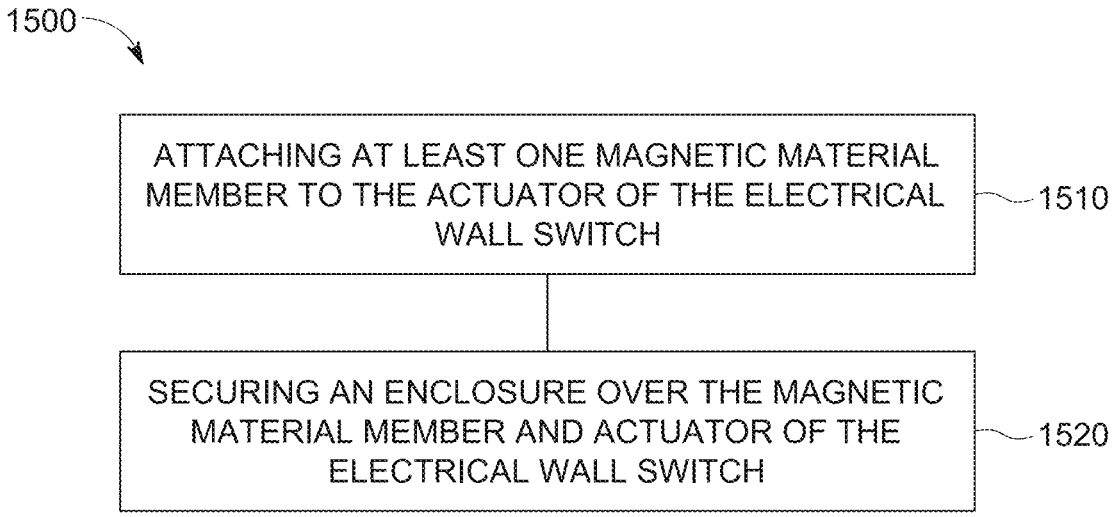
FIG. 26 is a flowchart of a method for inhibiting physical contact with an actuator of an electrical wall switch, according to embodiment of the present disclosure.

FIG. 26 illustrates a method 1500 for inhibiting physical contact with an actuator of an electrical wall switch, according to embodiment of the present disclosure. The electrical wall switch is operable for controlling electrical power to a load from an electrical power source. The method 1500 include at 1510 attaching at least one magnetic material member to the actuator of the electrical wall switch, and at 1520 securing an enclosure over the magnetic material member and actuator of the electrical wall switch.

In further embodiments, the enclosure completely surrounds the actuator on all sides. The enclosure may be configured to be operably secured with conventional screws or longer provided screws that are used to secure the wall switch plate. For example, the enclosure may be sized to extend closely over the actuator, not include the cross members, and include an upwardly-extending flange adjacent the opening of the enclosure and a downwardly extending flange adjacent the opening of the enclosure, which flanges have holes alignable with and for receiving the screws for securing the switch plate to the electrical wall switch. In other embodiments, the enclosure may be an integral part of a wall switch plate.

While a toggle electrical wall switch, rocker electrical wall switch, and a dimmer switch have been illustrated and described, it will be appreciated that the technique of the present disclosure may be employed with any other existing electrical wall switch or other electrical switch now know or later developed.

As may be recognized by those of ordinary skill in the art based on the teachings herein, numerous changes and modifications may be made to the above-described and other embodiments of the present disclosure without departing from the scope of the disclosure. In addition, the devices and apparatus may include more or fewer components or features than the embodiments as described and illustrated herein. Further, the above-described embodiments and/or aspects thereof may be used in combination with each other. Accordingly, this detailed description of the currently-preferred embodiments is to be taken as illustrative, as opposed to limiting the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The disclosure has been described with reference to the preferred embodiments. It will be understood that the architectural and operational embodiments described herein are exemplary of a plurality of possible arrangements to provide the same general features, characteristics, and general apparatus operation. Modifications and alterations will occur to others upon a reading and understanding of the preceding detailed description. It is intended that the disclosure be construed as including all such modifications and alterations.

The invention claimed is:

1. A protective cover assembly for an electrical wall switch disposed on a wall, the electrical wall switch having an actuator physically contactable and actuatable by a user for controlling electrical power to an electrical load from an electrical power source, said protective cover assembly comprising:

an enclosure having a sidewall having an inner surface and an outer surface;

a connector for connecting said enclosure over the electrical wall switch to inhibit the user from physically contacting and actuating the actuator of the electrical wall switch;

a slider slidably mounted within said enclosure and engageable with the actuator of the electrical wall switch, said slider movable between a first position and a second position along said inner surface of said enclosure, and said slider having a first magnetic material member;

a tool having a second magnetic material member, said first magnetic material member and said second magnetic material member operable to form a magnetic force therebetween;

wherein when the user moves said tool in a first axial direction along said outer surface of said enclosure covering the electrical wall switch, the magnetic force acting through said enclosure is operable to move said slider from said first position to said second position thereby moving the actuator from a first position to a second position for controlling the electrical power to the electrical load;

wherein when the user moves said tool in a second axial direction along said outer surface of said enclosure covering the electrical wall switch, the magnetic force acting through said enclosure is operable to move said slider from said second position to said first position thereby moving the actuator from the second position to the first position for controlling electrical power to the electrical load; and wherein said slider comprises a C-shaped member having a web portion disposed adjacent to said inner surface, and a pair of spaced-apart arms operable for receiving a portion of the actuator therebetween.

2. The protective cover assembly of claim 1 wherein said pair of spaced-apart arms are operable for receiving a toggle lever of the actuator therebetween.

3. The protective cover assembly of claim 1 wherein said pair of spaced-apart arms are operable for receiving a slider portion of the actuator therebetween.

4. The protective cover assembly of claim 1 further comprising an adapter releasably attachable to said spaced-apart arms and comprising a portion engageable with a surface rocker portion of the actuator.

5. The protective cover assembly of claim 1 wherein said first magnetic material member is slidable against said inner surface of said enclosure.

6. The protective cover assembly of claim 1 wherein said slider and said first magnetic material member comprises a monolithic one-piece slider formed from a magnetic material.

7. The protective cover assembly of claim 1 wherein said enclosure comprises a front wall disposable over the actuator of the electrical wall switch and a surrounding peripherally-extending sidewall extending towards the electrical wall switch.

8. The protective cover assembly of claim 7 wherein said enclosure comprises a rectangular front wall, said surrounding sidewall comprises a horizontal top side wall, a horizontal bottom sidewall, a right vertical sidewall, and a left vertical sidewall defining a rectangular opening, and wherein said opening of said surrounding sidewall comprises a rectangular opening having a width between 2.7 inches and 3.5 inches, and a length between 4.5 inches to 5.5 inches.

9. A protective cover assembly for an electrical wall switch disposed on a wall, the electrical wall switch having an actuator physically contactable and actuatable by a user for controlling electrical power to an electrical load from an electrical power source, said protective cover assembly comprising:

an enclosure having a sidewall having an inner surface and an outer surface;

a connector for connecting said enclosure over the electrical wall switch to inhibit a user from physically contacting and actuating the actuator of the electrical wall switch;

at least one first magnetic material member attachable to the actuator;

a tool having a second magnetic material member, said first magnetic material member and said second magnetic material member forming a magnetic force therebetween; wherein when the user moves said tool in a first direction adjacent to said outer surface of said enclosure covering said at least one first magnetic material member attached to the actuator, the magnetic force acting through said enclosure is operable to move the actuator from a first position to a second position for controlling the electrical power to the electrical load;

wherein when the user moves said tool a second direction adjacent to said outer surface of said enclosure covering said at least one first magnetic material member attached to the actuator, the magnetic force acting through said enclosure is operable to move the actuator from the second position to the first position for controlling electrical power to the electrical load; and at least one of:

said at least one first magnetic material member comprises an adhesive layer having a first surface attached to said at least one first magnetic material member, and a release layer attached to a second surface of said adhesive layer; and said at least one first magnetic material member comprises a cap expendable over a toggle lever of the actuator.

10. The protective cover assembly of claim 9 wherein said at least one first magnetic material member comprises said adhesive layer having a first surface attached to said at least one first magnetic material member, and said release layer attached to said second surface of said adhesive layer.

11. The protective cover assembly of claim 9 wherein said at least one first magnetic material member comprises said cap expendable over the toggle lever of the actuator.

12. The protective cover assembly of claim 9 wherein said enclosure comprises a rectangular front wall, said surrounding sidewall comprises a horizontal top side wall, a horizontal bottom sidewall, a right vertical sidewall, and a left vertical sidewall defining a rectangular opening, and wherein said opening of said surrounding sidewall comprises a rectangular opening having a width between 2.7 inches and 3.5 inches, and a length between 4.5 inches to 5.5 inches.

13. A protective cover assembly for an electrical wall switch disposed on a wall, the electrical wall switch having an actuator physically contactable and actuatable by a user for controlling electrical power to an electrical load from an electrical power source, said protective cover assembly comprising:

an enclosure having a sidewall having an inner surface and an outer surface;

a connector for connecting said enclosure over the electrical wall switch to inhibit a user from physically contacting and actuating the actuator of the electrical wall switch;

at least one first magnetic material member attachable to the actuator;

a tool having a second magnetic material member, said first magnetic material member and said second magnetic material member forming a magnetic force therebetween; wherein when the user moves said tool in a first direction adjacent to said outer surface of said enclosure covering said at least one first magnetic material member attached to the actuator, the magnetic force acting through said enclosure is operable to move the actuator from a first position to a second position for controlling electrical power to the electrical load;

wherein when the user moves said tool a second direction adjacent to said outer surface of said enclosure covering said at least one first magnetic material member attached to the actuator, the magnetic force acting through said enclosure is operable to move the actuator from the second position to the first position for controlling the electrical power to the electrical load, and further comprising said electrical wall switch comprising:

a housing;

a controller disposed in said housing for controlling the electrical power to the electrical load;

said actuator movable between the first position and the second position, said actuator having an outer surface; and wherein said at least one magnetic material member attachable to the actuator comprises the at least one magnetic material member disposed in said actuator below said outer surface; and wherein said actuator comprises a toggle having a toggle lever, and wherein said at least one magnetic material member is disposed in said toggle lever.

14. A method for operating an electrical wall switch for controlling electrical power to an electrical load from an electrical power source, the method comprising:

moving, via a magnetic force acting through an enclosure disposed over an actuator of the electrical wall switch, the actuator from a first position to a second position without physically contacting the actuator to control the electrical power to the electrical load;

moving, via the magnetic force acting through the enclosure disposed over the actuator of the electrical wall switch, the actuator from the second position to the first position without physically contacting the actuator to control the electrical power to the electrical load; and wherein the said actuator comprises a toggle having a toggle lever, and wherein at least one magnetic material member is disposed in the toggle lever.

15. The method of claim 14 further comprising securing the enclosure over the actuator of the electrical wall switch.

16. The method of claim 14 further comprising moving a tool having a magnetic material member to provide the magnetic force acting through the enclosure.

* * * * *